US010927514B1

(12) United States Patent
Tunis

(10) Patent No.: US 10,927,514 B1
(45) Date of Patent: Feb. 23, 2021

(54) CONCRETE JOINTER TOOL

(71) Applicant: Franklin D. Tunis, Lafayette, IN (US)

(72) Inventor: Franklin D. Tunis, Lafayette, IN (US)

( * ) Notice: Subject to any disclaimer, the term of this patent is extended or adjusted under 35 U.S.C. 154(b) by 0 days.

(21) Appl. No.: 16/453,297

(22) Filed: Jun. 26, 2019

(51) Int. Cl.
*E01C 23/02* (2006.01)
*E04F 21/24* (2006.01)

(52) U.S. Cl.
CPC ..... *E01C 23/025* (2013.01); *E04F 21/244* (2013.01)

(58) Field of Classification Search
CPC ..... E01C 19/44; E01C 23/02; E01C 23/025; E04F 21/244
USPC ..... 15/235.3, 235.4; D8/45; 404/87, 89, 97
See application file for complete search history.

(56) References Cited

U.S. PATENT DOCUMENTS 1,027,396 A * 5/1912 Abram ..... E04F 21/165 15/235.3
1,295,735 A * 2/1919 Grundmann ..... E04F 21/04 15/235.3
1,348,639 A * 8/1920 Grundmann ..... E04F 21/161 15/235.3
1,416,521 A * 5/1922 Stout ..... E01C 19/44 15/105
1,489,331 A 4/1924 Mull
1,769,631 A * 7/1930 Fischer ..... E01C 23/025 404/87
2,239,585 A * 4/1941 Amundsen ..... E04F 21/16 30/317
2,617,336 A * 11/1952 Brickler ..... E01C 23/025 404/89
3,671,075 A * 6/1972 Eyre ..... E21C 35/183 299/112 R
3,806,268 A * 4/1974 Francis ..... E04F 21/165 404/89
4,128,358 A 12/1978 Compton
4,397,581 A * 8/1983 Jarvis ..... E06B 7/2307 15/235.4
4,822,209 A * 4/1989 Dragich ..... E01C 23/026 404/89
5,098,278 A * 3/1992 Brandvold ..... B28B 7/0085 15/235.3
D333,600 S * 3/1993 Brandvold ..... D8/45
5,249,886 A * 10/1993 Huerta, Jr. ..... E01C 23/025 15/144.1
5,687,448 A * 11/1997 Dye, Jr. ..... B25G 3/30 15/144.1
5,910,087 A 6/1999 Carter
5,956,912 A 9/1999 Carter et al.
6,138,318 A * 10/2000 Pyatt ..... B28B 11/08 15/235.4
7,150,064 B2 12/2006 Edwards
D584,586 S * 1/2009 Lawrence ..... D8/45
7,610,648 B2 * 11/2009 Bongiovanni ..... E04F 21/162 15/235.4
7,644,467 B2 * 1/2010 Kleinhammer ..... E04F 21/165 15/104.001

(Continued)

*Primary Examiner* — Thomas B Will
*Assistant Examiner* — Katherine J Chu
(74) *Attorney, Agent, or Firm* — Cramer Patent & Design, PLLC; Aaron R. Cramer

(57) ABSTRACT

A concrete jointer tool has a handle pivotally mounted to a float. The float includes a planar portion having a blade removably attached to a bottom thereof. The handle is capable of receiving an elongated pole for operation of the tool from distance. The tool is capable of producing control joints in poured concrete.

16 Claims, 4 Drawing Sheets

(56) References Cited

U.S. PATENT DOCUMENTS

| | | | | |
|---|---|---|---|---|
| 8,277,144 | B1 * | 10/2012 | Bayley | E01C 19/44 15/235.4 |
| 9,151,010 | B2 | 10/2015 | Ong | |
| 9,506,206 | B2 | 11/2016 | Pucciarelli | |
| D773,912 | S * | 12/2016 | Gringer | D8/45 |
| 9,995,048 | B1 | 6/2018 | Gamelin | |

* cited by examiner

CONCRETE JOINTER TOOL

FIELD OF THE INVENTION

The present invention relates to a concrete jointer tool.

BACKGROUND OF THE INVENTION

Control joints are an important part of many masonry projects. As anyone who works with concrete knows. Without the regular placement of a control joint across a span of concrete, the pour—when hardening, may crack due to tensile stress. Normally, control joints are put into hardening concrete by use of a joint groover. While joint groovers are widely known and utilized in the industry, they are prone to wear and tear which over time makes a given groover ineffective for creating sharp control joints.

Accordingly, there exists a need for a means by which control joints may be consistently and efficiently created without repeated wear and tear upon a groover tool. The development of the concrete jointer tool 10 fulfills this need.

SUMMARY OF THE INVENTION

The inventor has recognized the aforementioned inherent problems and lack in the art and observed that there is a need for a concrete jointer tool, comprises a float including a planar portion having a top side, a bottom side, a rear edge, a front edge, and a pair of side edges. The float comprises a blade. The blade produces a control joint in a concrete forming process. The blade is fastened to the planar portion along a bisecting axial centerline, traveling from the rear edge to the front edge on the bottom side of the planar portion. The blade is located on the opposing side from the mounting bracket. The tool also comprises a handle pivotally mounted to the float. The tool also comprises a mounting bracket upstanding from a central position on the top side of the planar portion. The mounting bracket is capable of removably mounting the handle. The tool also comprises a handle mounting arm which has a hinge assembly. The hinge assembly is attached to or is integral with an upper end of the handle mounting arm and a slot is formed at a lower end of the handle mounting arm. The slot may be wide enough to permit passage of the mounting bracket therethrough.

The tool also comprises a pair of handle arms which are attached to an outer surface of the closed first end of the handle. The handle arms are hingedly attached to the hinge assembly to enable pivoting radial motion of the handle relative to the handle mounting arm. The mounting bracket and the lower end of the handle mounting arm each have an aperture that when coaligned, permit the passage of a mounting bolt therethrough. The tool also comprises a mounting fastener which is removably attached to said mounting bolt after it engages the mounting bracket and the handle mounting arm that securely fastens the handle to the float.

The float may have a rectangular shape that is particularly suited to enable the concrete jointer tool to be guided by a plurality of form boards with straight edges when the concrete jointer tool is used to produce the control joint in the concrete forming process. The float may be made of an inert material that is resilient and capable of withstanding repeated uses or stainless steel. The blade may have a blade first end that terminates at a position one inch from the front edge of the planar portion. The blade may have a blade second end that terminates coextensive with the rear edge of the planar portion. The blade may be wedge-shaped along its length, with a point of the wedge oriented in the lowermost position and the flat planar upper portion of the wedge abutting the surface of the bottom side of the planar portion when attached thereto.

The blade first end may further have a pair of bevels on either side of the flat planar upper portion of the wedge of the blade that taper to a forwardmost pointed front end. The pair of bevels may enable the blade to slide through the concrete with minimal resistance as it travels therethrough and the wedge-shape of the blade provides the shape of the joint. The forwardmost pointed front end may be a knife edge and rendered perpendicular to the planar portion and depth of the blade is provided as desired during the specific needs of the end user of the adequate depth of the control joint as deemed necessary. The blade may be fastened to the planar portion with a blade fastener selected from the group consisting of a plurality of bolts, a plurality of washers, or a plurality of screws. The handle may be made of an inert material that is resilient and capable of withstanding repeated uses or the handle may be made of resilient synthetic plastic material.

The handle may be a generally hollow cylindrical body having a closed first end and an open second end, defining a receiver that is particularly suited to receive a cylindrical extension pole to enable use of the concrete jointer tool from a distance without a user having direct operation thereof by the handle. The pair of handle arms may be generally ring shaped and oriented in a perpendicular location relative to a longitudinal bisecting centerline passing through the receiver of the handle. The handle may taper from the open second end to the closed first end. The mounting bracket may have a planar body and may be oriented to stand vertically from the top side of the planar portion along a bisecting axial centerline, traveling from the rear edge of the float to the front edge of the float. The mounting bracket may have a curvilinear upper edge. The concrete jointer tool may be two feet in width and eight inches in length.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
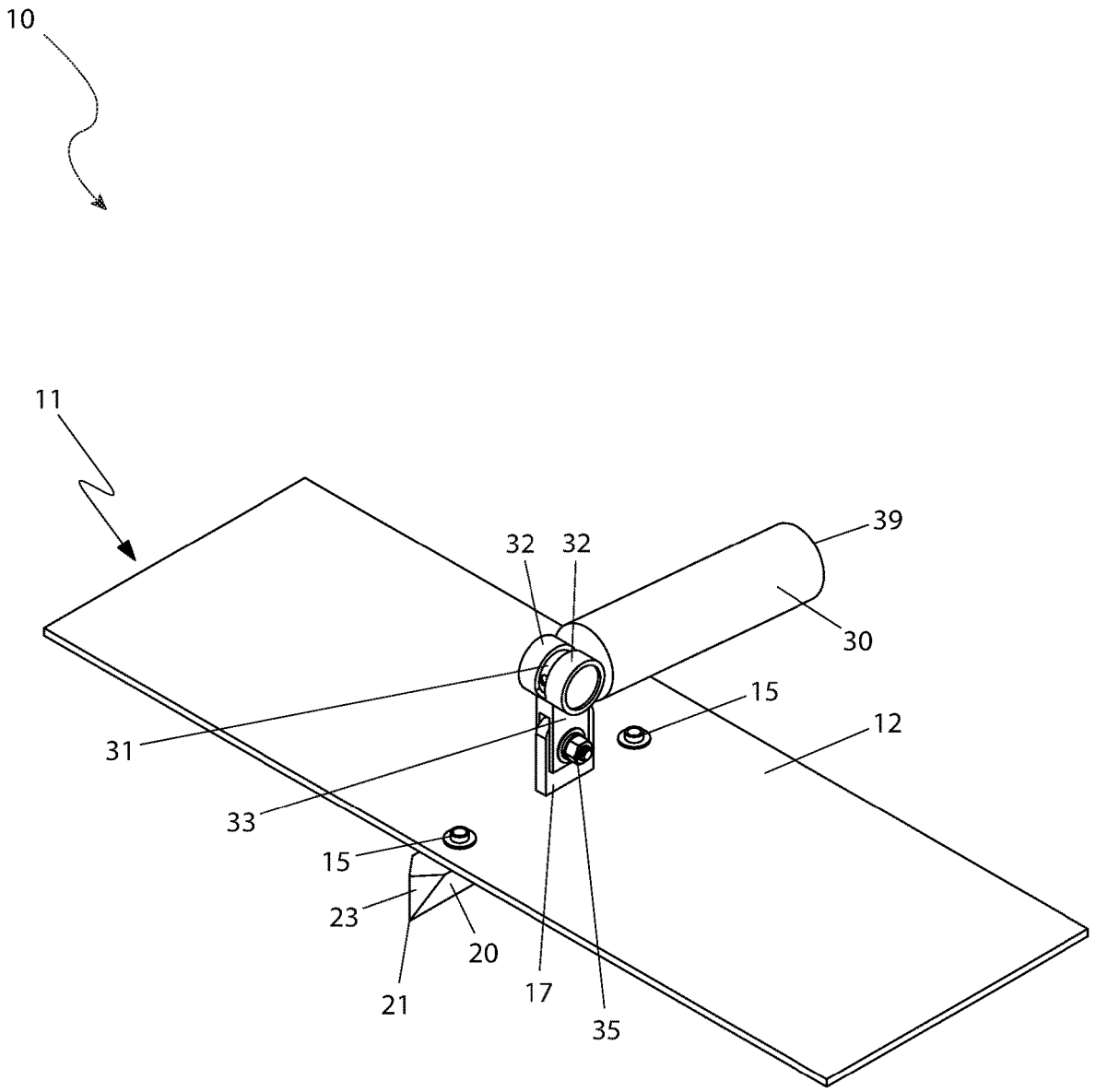
FIG. 1 is a perspective view of a concrete jointer tool 10, according to the preferred embodiment of the present invention.

10 concrete jointer tool
11 float
12 planar portion

15 blade fastener
17 mounting bracket
20 blade
21 blade first end
22 blade second end
23 bevel
30 handle
31 hinge assembly
32 handle arm
33 handle mounting arm
35 mounting fastener
36 mounting bolt
39 receiver

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, there is illustrated a concrete jointer tool (herein described as the "tool") 10 that is capable of producing control joints in finished concrete during a concrete forming process. This is done to prevent random cracking of the concrete when it dries and to predictably control where the cracking will occur. The tool 10 is typically used at the beginning on the concrete forming process, after the concrete is poured in the form and during the initial concrete setting. Often times, a second pass of the tool 10 through the concrete is required.

Figure 2:
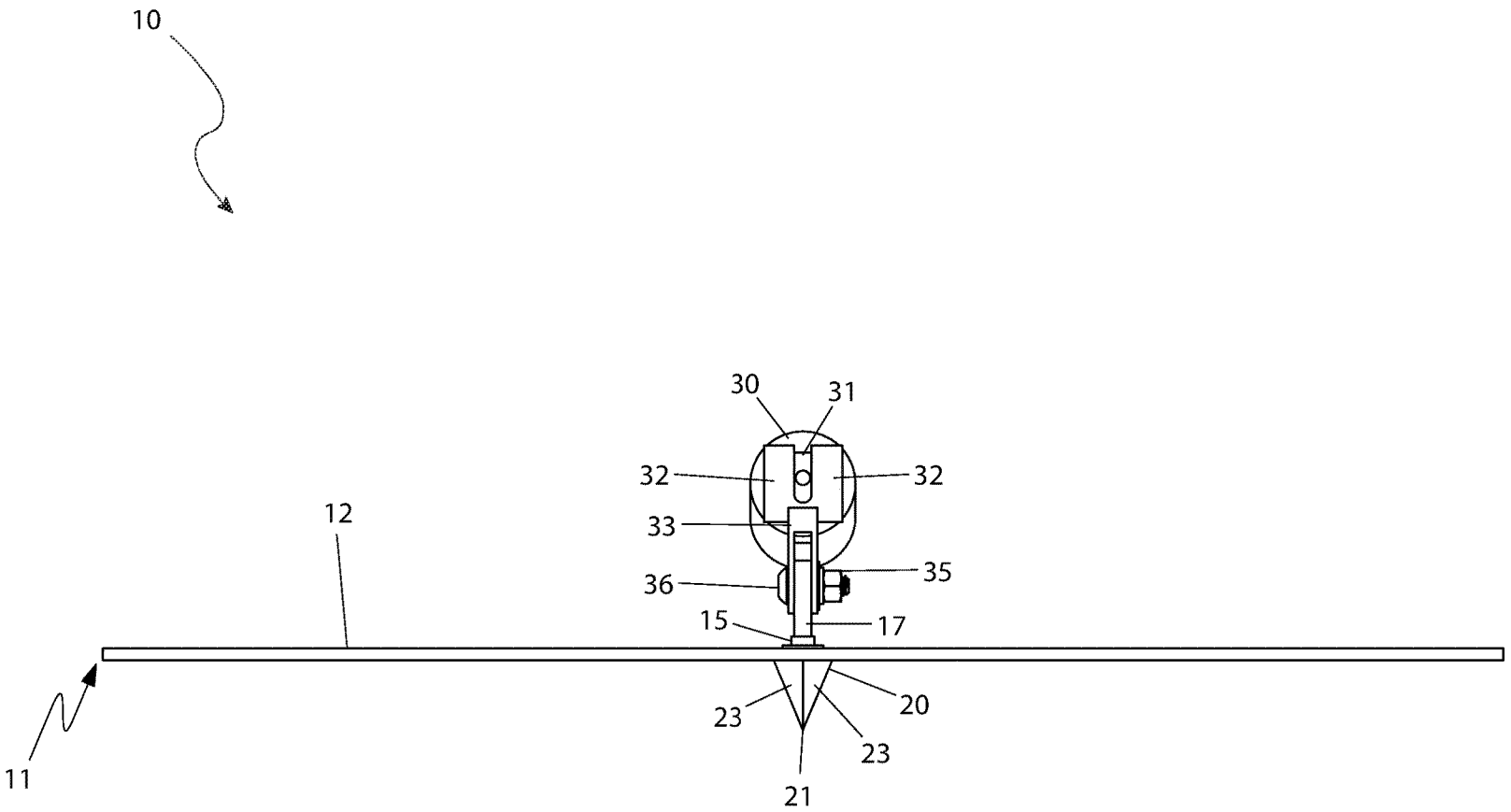
FIG. 2 is a front elevation view of the concrete jointer tool 10, according to the preferred embodiment of the present invention.
Figure 3:
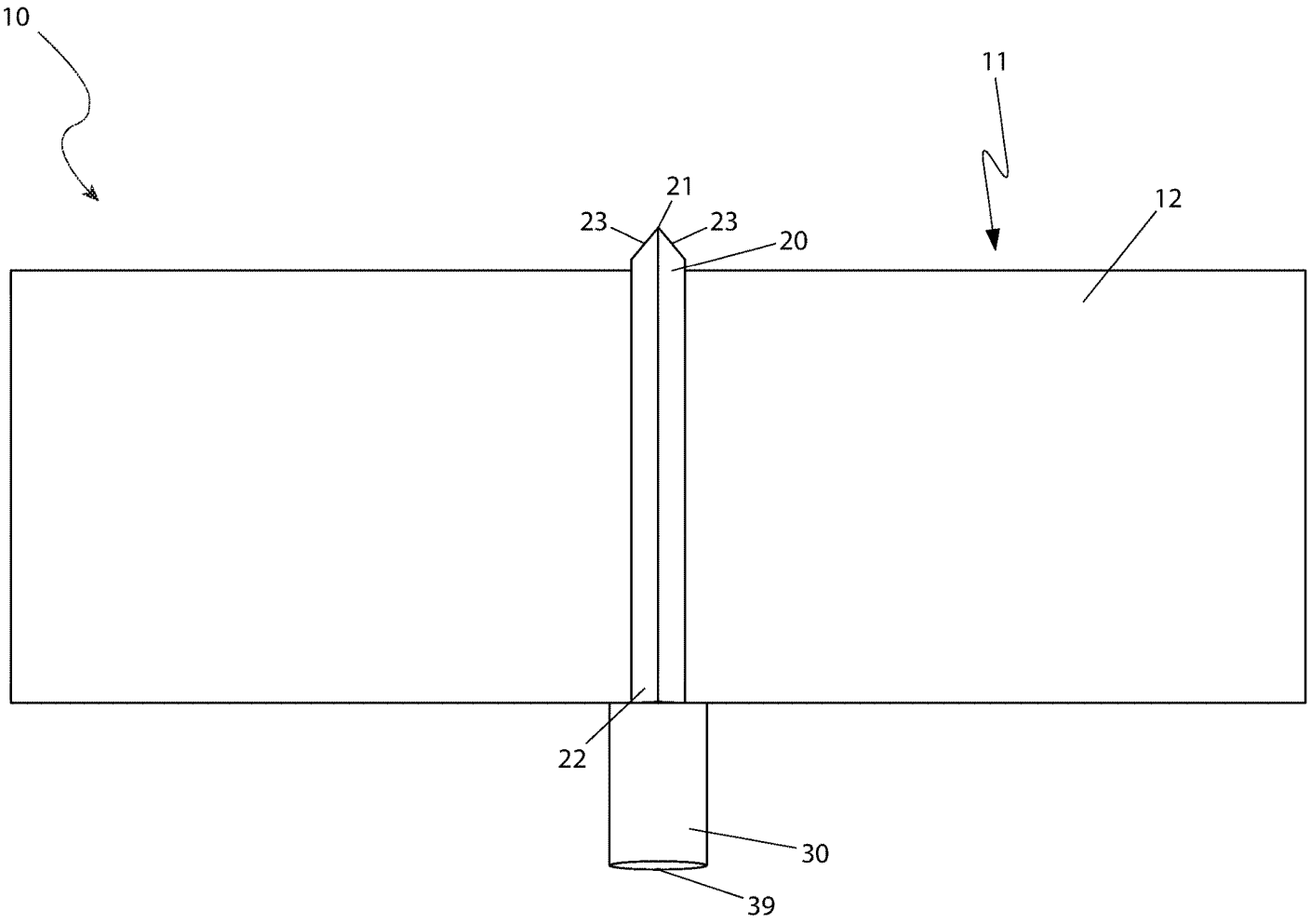
FIG. 3 is a bottom plan view of the concrete jointer tool 10, according to the preferred embodiment of the present invention.

Referring now to FIGS. 1 through 3, illustrations of various angles of the tool 10 is provided. The tool 10 includes a float 11 having a blade 20 to produce the control joint, and a handle 30 that is pivotally mounted to the float 11. The float 11 and blade 20 are preferably manufactured out of an inert material that is resilient and capable of withstanding repeated uses in a construction environment. Such a material is preferably stainless steel, although other materials may be used. The handle 30 is preferably a similar material capable as the float 11, and also may be a resilient synthetic plastic material.

The float 11 includes a planar portion 12 having a top side and a bottom side and is also preferably a rectangular shape. The planar portion 12 has a rear edge. A front edge, and a pair of side edges. The rear edge and front edge are defined as the long sides of the rectangular shape and the pair of side edges are defined as the short edges of the rectangular shape. The rectangular shape is particularly suited to enable the tool 10 to be guided by form boards with straight edges when the tool 10 is used to produce a control joint in a concrete forming process. In a preferred embodiment, the dimension of the tool 10 is approximately two feet (2 ft.) in width and eight inches (8 in.) in length. Upstanding from a central position on the top side of the planar portion 12 is a mounting bracket 17 capable of removably mounting the handle 30 thereto. The mounting bracket 17 has a planar body and oriented to stand vertically from the top side of the planar portion 12 along a bisecting axial centerline, traveling from rear edge to front edge. The mounting bracket 17 has a curvilinear upper edge.

Referring more closely to FIGS. 1 and 3, it is shown that the float 11 also includes a blade 20 which is fastened to the planar portion 12 along a bisecting axial centerline, traveling from rear edge to front edge on the bottom side. As such, the blade 20 is located on the opposing side from the mounting bracket 17. The blade 20 has a blade first end 21 that terminates at a position approximately one inch (1 in.) from the front edge of the planar portion 12. The blade 20 has a blade second end 22 that terminates coextensive with the rear edge of the planar portion 12. The blade 20 is preferably wedge-shaped along its length, with the point of the wedge oriented in the lowermost position and the flat planar upper portion of the wedge abutting the surface of the bottom side of the planar portion 12 when attached thereto. The blade first end 21 further has a pair of bevels 23 on either side of the flat planar upper portion of the wedge of the blade 20 that taper to a forwardmost pointed front end. This forwardmost pointed front end is a knife edge and rendered perpendicular to the planar portion 12. The bevels 23 enable the blade 20 to slide through the concrete with minimal resistance as it travels therethrough and the wedge-shape of the blade 20 provides the shape of the joint. The depth of the blade 20 can be provided as desired during the specific needs of the end user of the adequate depth of the control joint as deemed necessary. The blade 20 is fastened to the planar portion 12 with at least one (1) blade fastener 15, such as bolts, washers, screws, or other pertinent hardware.

Referring now more closely to FIGS. 1 and 2, which illustrate the attachment of the handle 30 to the planar portion 12. The handle 30 is a generally hollow cylindrical body with a closed first end and an open second end, defining a receiver 39. The handle 30 may have a continuous outer and inner diameter (i.e., the diameter of the receiver 39), or the inner diameter (i.e. the diameter of the receiver 39) may taper from the open second end to the closed first end. The receiver 39 is particularly suited to receive a cylindrical extension pole to enable the use of the tool 10 from distance without a user able to have direct operation thereof by the handle 30.

A handle mounting arm 33 is generally shaped as a yoke, having a hinge assembly 31 attached to or integral with an upper end thereof, and a slot formed at a lower end thereof, extending upward (i.e., towards the upper end) along a bisecting axial centerline. Attached to the outer surface of the closed first end of the handle 30 is a pair of handle arms 32, generally shaped as rings and oriented in a perpendicular location relative to a longitudinal bisecting centerline passing through the receiver 39 of the handle 30. The handle arms 32 are hingedly attached to the hinge assembly 31 to enable pivoting radial motion of the handle 30 relative to the handle mounting arm 33. The slot is wide enough to permit passage of the mounting bracket 17 therethrough. The mounting bracket 17 and the lower end of the handle mounting arm 33 each have apertures (not shown), that when coaligned, permit the passage of a mounting bolt 36 therethrough. A mounting fastener 35 removably attached to said mounting bolt 36, after it engages the mounting bracket 17 and handle mounting arm 33, securely fastens the handle 30 to the float 11.

2. Operation of the Preferred Embodiment

The preferred embodiment of the present invention can be utilized by the common user in a simple and effortless manner with little or no training. It is envisioned that the tool 10 would be constructed in general accordance with FIG. 1 through FIG. 4. The user would procure the tool 10 via conventional procurement channels such as construction supply stores or do-it-yourself or hardware stores. Special attention would be paid to construction specifics such as overall dimensions of the float 11, the depth of the blade 20, and the diameter of the receiver 39 of the handle 30.

Figure 4:
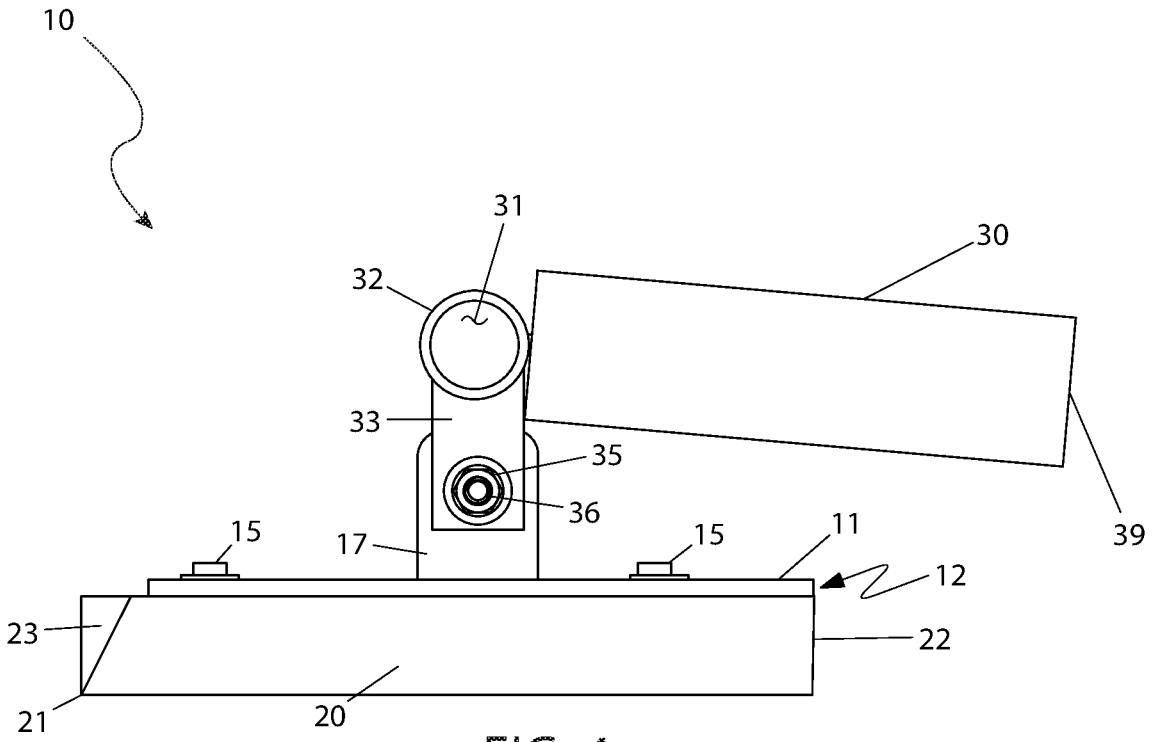
FIG. 4 is a side elevation view of the concrete jointer tool 10 with the handle 30 in a down configuration, according to the preferred embodiment of the present invention; and, FIG. 5 is a side elevation view of the concrete jointer tool 10 with the handle 30 in an up configuration, according to the preferred embodiment of the present invention.
Figure 5:
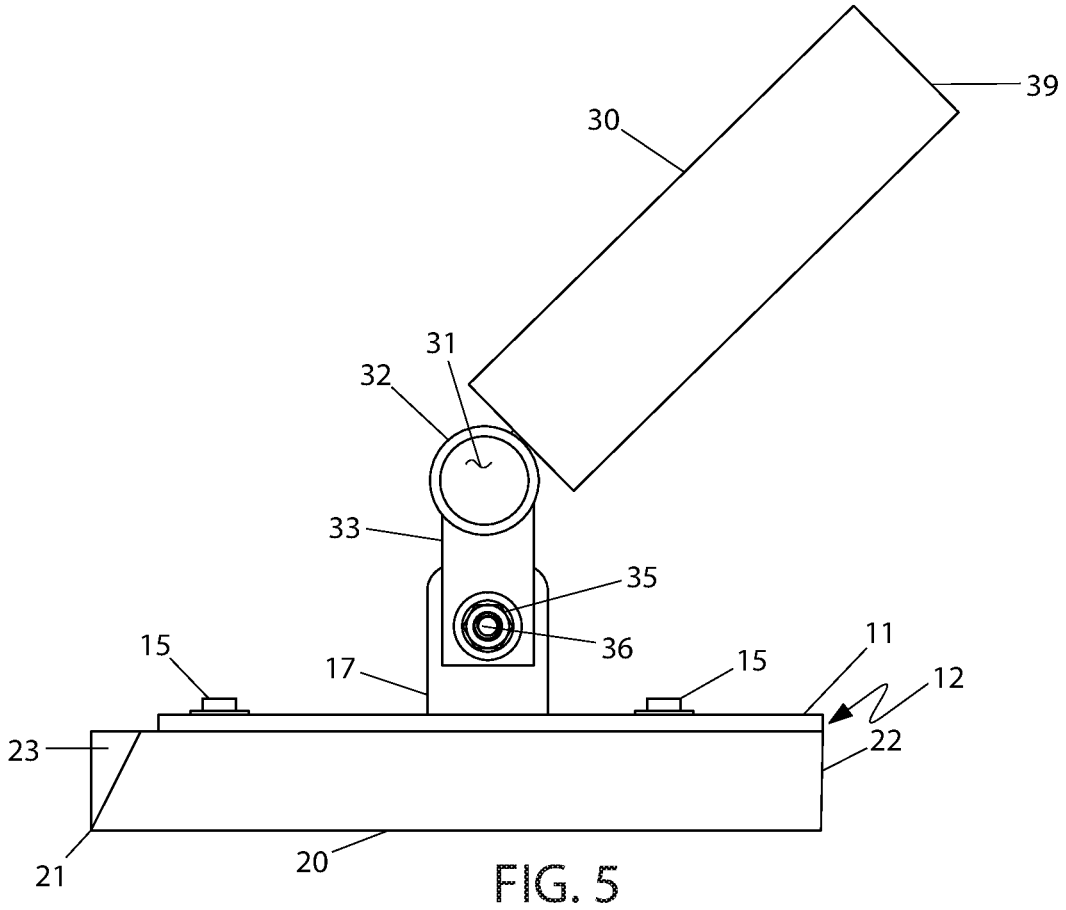

FIGS. 4 and 5 illustrate the ability of the handle 30 to be pivotally adjusted along the bisecting axial centerline (i.e., between the rear edge and front edge of the planar portion 12). Although the handle 30 is only illustrated as being adjustable between and angle of zero to approximately forty-five degrees (0°≈45°), it is appreciated that the handle 30 can be oriented to one hundred and eighty degrees (180°) relative to the illustration in FIG. 4 and any incremental position therebetween and the scope of the teachings herewithin are envisioned to accommodate such handle 30 positioning.

Upon a concrete pouring event and prior to complete hardening of the poured concrete, the tool 10 is procured and it is determined if a secondary extension pole is needed to insert into the receiver 39 of the handle 30 in order to manipulate the tool 10 from distance. The proper blade 20 is produced and attached to the planar portion 12 based on desired depth of the to-be-formed control joint. Also, if required or desired, form boards with straight edges are placed over the poured concrete at proper locations in order to provide a guide for travel of the tool 10 on the top of the concrete.

Once the above is determined and the location of the control joint to be formed with the tool 10 is identified, the float 11 of the tool 10 is placed on the leading edge of the poured concrete such that the bevels 23 of the blade 20 are in contact therewith. A linear motion of the tool 10 along the desired path of the to-be-formed control joint is then accomplished. The blade 20 cuts through the poured concrete and the planar portion 12 "floats" on top of the poured concrete to produce the control joint along the desired path.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A concrete jointer tool, comprising:

a float including a planar portion having a top side, a bottom side, a rear edge, a front edge, and a pair of side edges, the float having a blade, the blade producing a control joint in a concrete forming process, the blade is fastened to the planar portion along a bisecting axial centerline, traveling from the rear edge to the front edge on the bottom side of the planar portion, the blade is located on the opposing side from the mounting bracket;

a handle pivotally mounted to the float;

a mounting bracket upstanding from a central position on the top side of the planar portion, the mounting bracket is capable of removably mounting the handle thereto;

a handle mounting arm having a hinge assembly, the hinge assembly is attached to or is integral with an upper end of the handle mounting arm and a slot is formed at a lower end of the handle mounting arm, the slot is wide enough to permit passage of the mounting bracket therethrough;

a pair of handle arms attached to an outer surface of the closed first end of the handle, the handle arms are hingedly attached to the hinge assembly to enable pivoting radial motion of the handle relative to the handle mounting arm, the mounting bracket and the lower end of the handle mounting arm each have an aperture that when coaligned, permit the passage of a mounting bolt therethrough; and a mounting fastener removably attached to said mounting bolt after it engages the mounting bracket and the handle mounting arm that securely fastens the handle to the float wherein a blade first end further has a bevel on each side of a flat planar upper portion of a wedge of the blade that tapers to a forwardmost pointed front end; and wherein the forwardmost pointed front end is a knife edge wherein said knife edge is rendered perpendicular to the planar portion and depth of the blade.

2. The concrete jointer tool, according to claim 1, wherein the float has a rectangular shape that is particularly suited to enable the concrete jointer tool to be guided by a plurality of form boards with straight edges when the concrete jointer tool is used to produce the control joint in the concrete forming process.

3. The concrete jointer tool, according to claim 1, wherein the float is made of an inert material that is resilient and capable of withstanding repeated uses.

4. The concrete jointer tool, according to claim 3, wherein the float is made of stainless steel.

5. The concrete jointer tool, according to claim 1, wherein the blade first end terminates at a position one inch from the front edge of the planar portion.

6. The concrete jointer tool, according to claim 1, wherein the blade has a blade second end that terminates coextensive with the rear edge of the planar portion.

7. The concrete jointer tool, according to claim 1, wherein the blade is wedge-shaped along its length, with a point of the wedge oriented in the lowermost position and a flat planar upper portion of the wedge abutting the surface of the bottom side of the planar portion when attached thereto.

8. The concrete jointer tool, according to claim 1, wherein the bevels on each side enable the blade to slide through the concrete with minimal resistance as it travels therethrough and the wedge-shape of the blade provides the shape of the joint.

9. The concrete jointer tool, according to claim 1, wherein the blade is fastened to the planar portion with a blade fastener selected from the group consisting of a plurality of bolts, a plurality of washers, or a plurality of screws.

10. The concrete jointer tool, according to claim 1, wherein the handle is made of an inert material that is resilient and capable of withstanding repeated uses.

11. The concrete jointer tool, according to claim 10, wherein the handle is made of resilient synthetic plastic material.

12. The concrete jointer tool, according to claim 1, wherein the handle is a generally hollow cylindrical body having a closed first end and an open second end, defining a receiver that is particularly suited to receive a cylindrical extension pole to enable use of the concrete jointer tool from a distance without a user having direct operation thereof by the handle.

13. The concrete jointer tool, according to claim 12, wherein the pair of handle arms are generally ring shaped and oriented in a perpendicular location relative to a longitudinal bisecting centerline passing through the receiver of the handle.

14. The concrete jointer tool, according to claim 1, wherein the mounting bracket has a planar body and is oriented to stand vertically from the top side of the planar portion along a bisecting axial centerline, traveling from the rear edge of the float to the front edge of the float.

15. The concrete jointer tool, according to claim 1, wherein the mounting bracket has a curvilinear upper edge.

16. The concrete jointer tool, according to claim 1, wherein the concrete jointer tool is two feet in width and eight inches in length.

* * * * *